United States Patent [19]

Cline et al.

[11] 4,212,508

[45] Jul. 15, 1980

[54] COMPUTER INTERFACE RECEIVER RETROFIT KIT

[75] Inventors: Quentin E. Cline, Grottoes; Paul D. Floyd, Lyndhurst, both of Va.

[73] Assignee: Virginia Panel Corporation, Waynesboro, Va.

[21] Appl. No.: 30,759

[22] Filed: Apr. 17, 1979

[51] Int. Cl.[3] ..... H01R 29/00

[52] U.S. Cl. ..... 339/18 B

[58] Field of Search ..... 339/18 R, 18 B, 18 C, 339/18 P, 198 R, 198 G, 31 R

[56] References Cited

U.S. PATENT DOCUMENTS 3,419,842 12/1968 Taylor, Jr. ..... 339/18 B

*Primary Examiner*—Neil Abrams

*Attorney, Agent, or Firm*—B. P. Fishburne, Jr.

[57] ABSTRACT

A conversion or retrofit kit includes an adapter bar for a receiver assembly which may readily be assembled to a receiver frame in the position normally occupied by a receiver module carrying contacts, which module is removed from the receiver assembly. The adapter bar in cooperation with one side rail of the receiver frame enables placement on the receiver of a smaller control panel having a lesser number of contacts to coact with the receiver contacts than the full size control panel for which the receiver is primarily designed. Simplicity of conversion and economy are paramount.

10 Claims, 11 Drawing Figures

FIG. 1
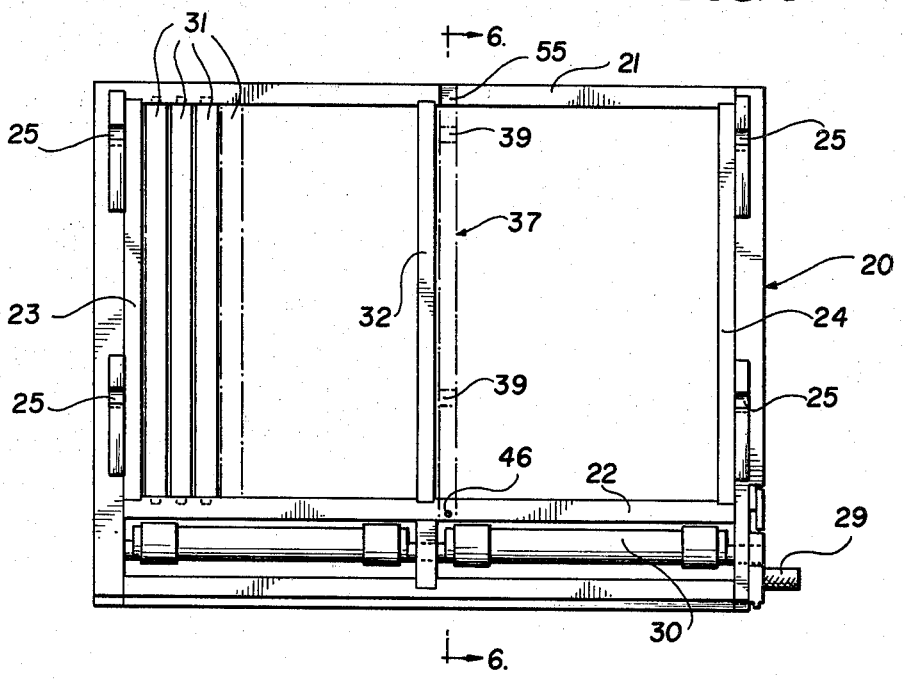
FIG. 2
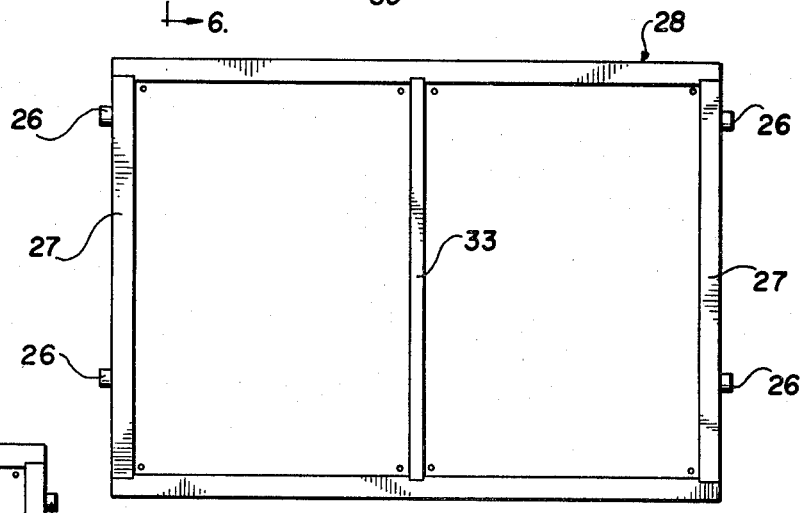
FIG. 3
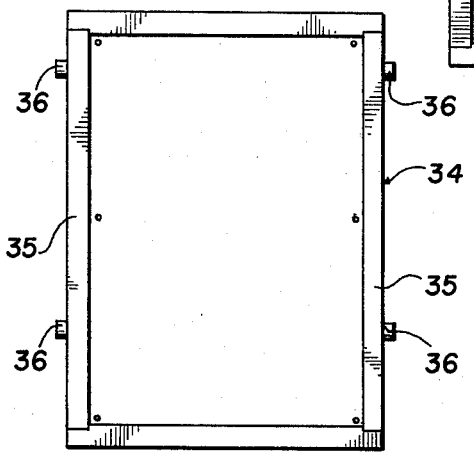
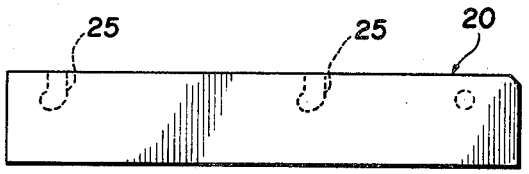
FIG. 4
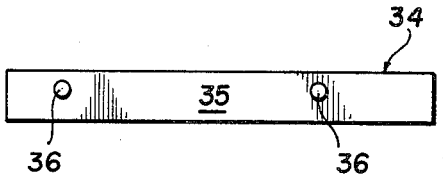
FIG. 5

COMPUTER INTERFACE RECEIVER RETROFIT KIT

BACKGROUND OF THE INVENTION

The invention arises as a result of a need in the computer interface equipment art for greater versatility of components. For example, a standard rectangular receiver assembly may contain 1632 receiver paddle contacts or coaxial contacts arranged in horizontal and vertical ranks and files. Customarily, such a receiver is constructed with a marginal rectangular frame composed of parallel top and bottom rails connected with parallel side rails perpendicular thereto. The ranks and files of receiver contacts aforementioned are carried by a plurality of module bars usually disposed in close side-by-side parallel relationship on the receiver frame and extending between the top and bottom rails of the receiver frame and coupled therewith. The individual module bars are removable and replaceable. Each module bar may carry several vertical files of contacts on predetermined centers.

A receiver of the above type normally receives in interfaced relationship a control panel of like size and shape also having ranks and files of contacts which interact with the receiver contacts when the control panel is coupled thereto with the assistance of positioning mechanism usually provided on the receiver.

In practice, it may be desirable and necessary to utilize a smaller control panel with a lesser number of contacts arranged in ranks and files, such as a half-size control panel having 816 contacts arranged in ranks and files instead of 1632 in the above practical example. To avoid the necessity for providing a half-size receiver for the 816 contact control panel, a very simplified and economical conversion kit is provided in accordance with the invention involving the use of an adapter bar assembly which is placed in the position of a single removed module bar near the center of the receiver being converted. The adapter bar is constructed to interlock removably with the top and bottom rails of the receiver in a precision manner and to coact with one receiver side rail in supporting and positioning the 816 contact control panel relative to the receiver in the required manner. The conversion can be carried out easily and quickly in the field or during manufacturing. The adapter bar is entirely compatible with standard receivers and control panels and requires no cutting or structural modification thereof other than the removal of one module bar from the receiver and the drilling of a single locator opening in the top face of the receiver bottom bar and the placement of a single socket head screw in the interior side face of the receiver bottom bar to cooperate with a spring-urged detent element of the adapter bar assembly.

The practical advantages of the invention will become fully apparent to those skilled in the art during the course of the following detailed description.

BRIEF DESCRIPTION OF THE DRAWINGS

FIG. 1 is a plan view of a receiver forming a component of computer interface equipment.

FIG. 2 is a plan view of a control panel sized to mate with the receiver shown in FIG. 1.

FIG. 3 is a similar plan view of a half-size receiver.

FIG. 4 is a side elevation of the receiver in FIG. 1 as viewed from the left side of FIG. 1.

FIG. 5 is a side elevation of the receiver in FIG. 3.

DETAILED DESCRIPTION

Figure 6:
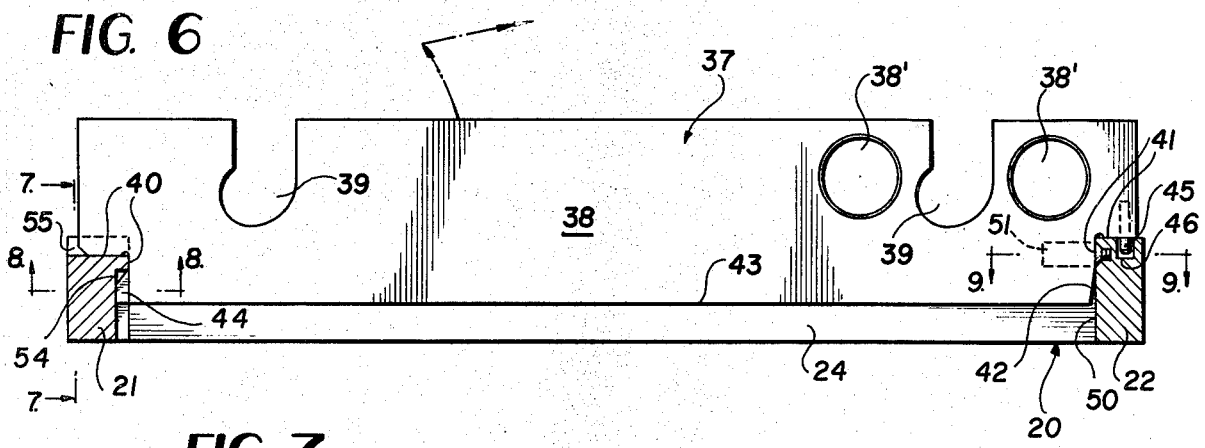
FIG. 6 is an enlarged vertical section taken on line 6—6 of FIG. 1 and showing an adapter bar assembly in position on the receiver of FIG. 1.

Referring to the drawings in detail wherein like numerals designate like parts, the numeral 20 designates a receiver such as a 1632 contact receiver having parallel top and bottom rails 21 and 22 joined with precision to right angular parallel side rails 23 and 24 in accordance with known practice. The receiver side rails are provided in their top faces with J-slots 25 to receive side projecting locator lugs or pins 26 on the opposite side bars 27 of a rectangular control panel 28 which is sized to mate with the receiver 20 in assembled relationship and in a manner well known in the art. The control panel 28 allso has ranks and files of electrical contacts, hidden in FIG. 2, which interengage with contacts on the receiver 20 in a known manner.

The receiver 20 is equipped with a manually operated mechanism including a handle 29 and roll cam bar means 30 to act on the control panel 28 when its locator lugs 26 are within the J-slots 25 for forcing the control panel to a locked position at the bottoms of the J-slots 25 where its multiple contacts will properly engage the mating contacts of the receiver 20.

The contacts arranged in horizontal ranks and vertical files on the receiver 20 are carried by a plurality of side-by-side parallel closely spaced module bars 31, several of which are shown in FIG. 1, and which collectively span substantially the full width of the receiver 20 in the two areas on opposite sides of a center reinforcing receiver frame bar 32. The opposite ends of the module bars 31 are rigidly and removably coupled to the top and bottom rails 21 and 22 of the receiver 20. The control panel 28 may also have a center reinforcing bar or member 33.

The constructions thus far described are conventional and known in the art and a more detailed description of them is not essential to a full understand of the present invention.

As discussed in the introductory portion of the application, the invention is concerned with convertng the receiver 20 to accept a smaller or half-size control panel 34, FIG. 3, in lieu of the larger control panel 28. In the case of a 1632 contact control panel 28, the control panel 34 would be equipped with 816 contacts arranged in ranks and files which are hidden in FIG. 3. Thus, the control panel 34 is in effect a half-size control panel compared to the full size control panel 28 designed for the particular receiver 20. It should be understood that the invention is in no way limited to these precise numbers and sizes, the concept being to adapt or convert a larger receiver to accept a smaller than normal control panel regardless of the particular fractional size of the smaller control panel.

The half-size control panel 34 carries on its side rails 35 spaced projecting locator lugs 36 identical to the lugs 26 and on the same spaced centers as the lugs 26, so as to be acceptable within the receiver J-slots 25.

As previously noted, in the conversion of the receiver 20 to accept the smaller control panel 34, one receiver contact module bar 31 immediately to the right of center member 32, FIG. 1, is removed and replaced by an adapter bar assembly 37 forming a key element of the invention. The adapter bar assemmbly 37 comprises an adapter bar body 38 whose thickness, FIG. 1, is substantially equal to the thickness of the module 31 which it replaces in the receiver. In its top face, the adapter bar is provided with a pair of spaced J-slots 39 having the same size and spacing as the J-slots 25 in the receiver 20. When the adapter bar assembly 37 is in position on the receiver 20, the open tops of its J-slots 39 will be in a common plane with the open tops of the J-slots 25 to accept the locator lugs 36 of the control panel 34, which lugs are also in a common plane.

At its opposite ends and on its longitudinal edge away from the slots 39, the adapter bar 38 is notched to form precise right angular locator faces 40 at one end thereof and similar right angular faces 41 at the other end thereof. One of the faces 41 on the adapter bar 38 is relieved on an angle at 42 and intersects the lower longitudinal edge 43 of the adapter bar, as shown, to provide assembly clearance with the bottom rail 22 of the receiver. A short projecting reduced width beveled locator tongue 44 is formed on the face 40 of the adapter bar 38 which is normal to the edge 43. The other locator face 40 has no corresponding projection or tongue thereon.

A guide pin 45 projects below the locator face 41 which is parallel to the edge 43 of the adapter bar, and the guide pin is in spaced parallel relationship to the other face 41 which is normal to the edge 43. The guide pin 45 is press-fitted into a provided opening formed in the adjacent locator face 41. The top face of the receiver rail 22 is provided with a slightly elongated receiver opening 46, or slot, for the guide pin 45 to accept the same without mechanical interference when the adapter bar assembly 37 is placed on the receiver 20.

Figure 9:
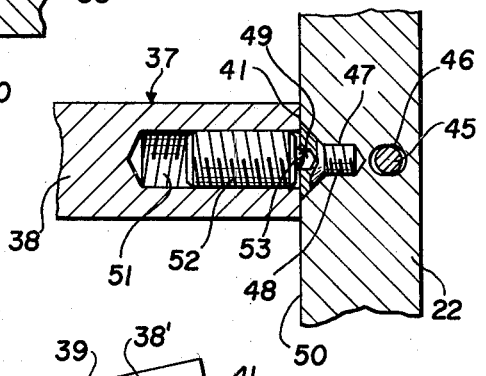
FIG. 9 is a similar section taken on line 9—9 of FIG. 6.

The interior side face of the receiver rail 22, FIG. 9, is drilled, tapped and countersunk at 47 to receive a short flat head screw 48 whose conical head has a socket opening 49. The top face of the screw head is flush with the adjacent side surface 50 of the rail 22 when the parts are assembled. The axis of the screw 48 is perpendicular to the axis of guide pin 45 and opening 46, and these axes are in a common plane in the assembled device.

The face 41 which is parallel to the axis of guide pin 45 has a threaded bore 51 formed therein to receive a threaded body 52 of a spring-loaded ball detent 53 which is adjusted in the assembly 37 to project beyond the adjacent face 41 and to have releasable locking engagement in the socket opening 49 of screw 48 when the adapter bar assembly 37 is in place on receiver 20.

Figure 7:
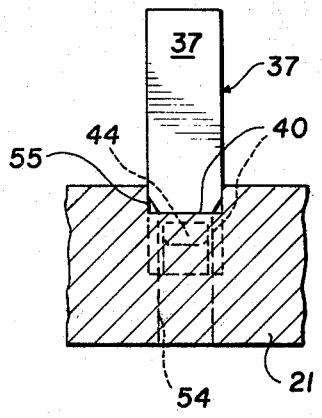
FIG. 7 is a fragmentary vertical section taken on line 7—7 of FIG. 6.
Figure 8:
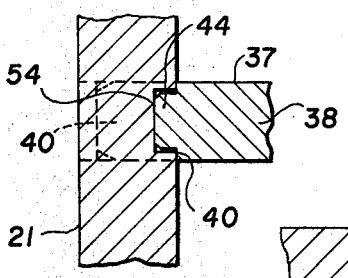
FIG. 8 is a fragmentary horizontal section taken on line 8—8 of FIG. 6.

As shown in FIG. 7 and elsewhere in the drawings, when the adapter bar assembly 37 is properly in place, as indicated in phantom lines in FIG. 1, its surface 41 having the guide pin 45 rests solidly on the bottom rail 22 of the receiver frame with the guide pin 45 within the opening 46 of the rail 42 and the ball detent 53 engaged within the socket opening 49. At the far end of the assembly 37, the projecting tongue 44 is received within a recess 54 in the receiver top rail 21 while the right angular surfaces 40 of the adapter bar solidly engage the corresponding faces of the rail 21. The top face of rail 21 also has formed therein a locator recess 55 for the assembly 37 to position the assembly fixedly and in proper parallel relationship to the side rail 24 of the receiver, in cooperation with the guide pin 45. The adapter bar 38 is provided with a pair of finger holes 38' for use in extracting the adapter bar from the receiver frame with which it is associated.

Figure 10:
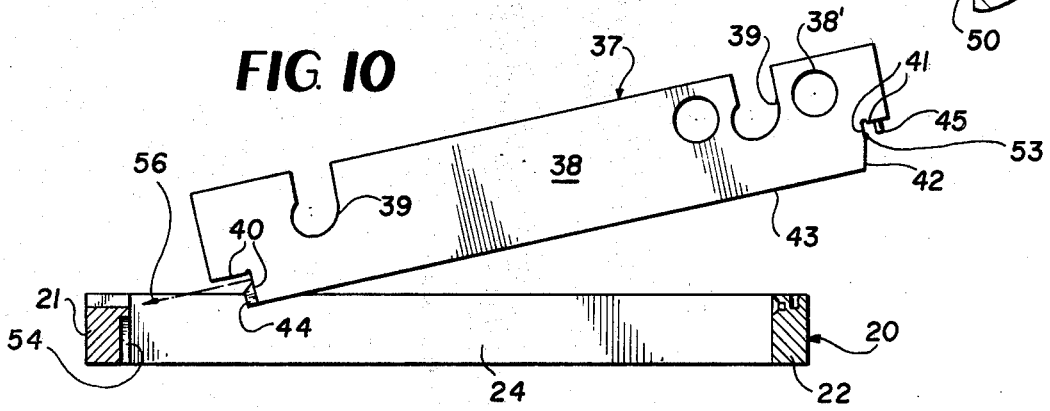
FIGS. 10 and 11 are elevational views, partly in cross section, depicting the operation of positioning the adapter bar assembly on the frame of the receiver undergoing conversion.
Figure 11:
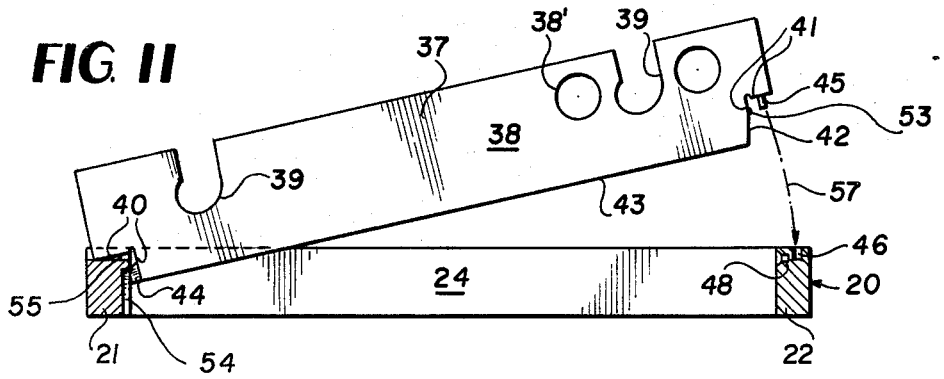

FIGS. 10 and 11 show the manner in which the adapter bar assembly 37 is moved into assembled relationship with the receiver 20. With the assembly 37 inclined relative to the receiver 20, it is moved in the direction of the arrow 56 toward the rail 21 until the locating and locking tongue 44 enters the recess 54 and the adjacent end portion of the adapter bar 38 above the tongue 44 slides into the locator recess 55. This condition is depicted in FIG. 11. The far end of the assembly 37 is now swung downwardly in the direction of the arrow 57, and the guide pin 45 will enter elongated opening 46 and detent ball 53 will substantially simultaneously drop into the socket opening 49 to complete the assembled relationship of the parts as shown in FIG. 6. The adapter bar assembly 37 is easily separated from the receiver 20, if this is desired, by a reverse sequence of movements indicated by the two arrows in FIG. 6.

Thus, by a simple removal of one contact module bar 31 from the receiver 20 near the center of the latter and the replacement of this module bar by the adapter bar assembly 37 in the manner just described, the conversion of the receiver to accept the smaller control panel 34 is completed. The control panel 34 is applied to the receiver and locked into place by the camming means 29–30 in the same manner previously described for the full size control panel 28. The only difference is that one set of the locator lugs 36 on control panel 34 enter the J-slots 39 of the adapter bar assembly 37 and the other set of lugs 36 enter the J-slots 25 of receiver 20 in the illustrated form of the invention. The J-slots 25 of the far side rail 23 are not used at this time. Whenever the smaller control panel 34 is removed from the receiver and the adapter bar assembly 37 is removed and replaced by the module bar 31 previously separated from the receiver, the receiver 20 can again accept the full size control panel 28 in the customary manner.

The conversion or retrofit kit in accordance with the invention renders the interface equipment more versatile and of wider utility without duplication of cost or any significant increase in cost. The advantages of the invention will be readily recognized by those skilled in the art.

It is to be understood that the form of the invention herewith shown and described is to be taken as a preferred example of the same, and that various changes in the shape, size and arrangement of parts may be resorted to, without departing from the spirit of the invention or scope of the subjoined claims.

We claim:

1. In a receiver used in computer interface equipment or the like and being of a type having a rectangular frame and havng multiple electrical contacts carried by plural side-by-side contact module bars across said frame in one direction, said module bars being individually detachably connected to one pair of opposite rails of said frame, the other opposite rails of said frame having locating and locking slots for spaced locator lugs on opposite sides of a full size multi-contact control panel normally interfaced with said receiver releasably, the improvement comprising means to convert the receiver for acceptance of a smaller size multi-contact control panel capable of spanning only a portion of the receiver and having opposite side spaced locator lugs of the same size and spacing as the locator lugs of said full size control panel, said means comprising an adapter bar assembly mountable on said frame in the position of one contact module bar removed from the receiver near the center thereof, said adapter bar assembly being constructed for releasable interlocking engagement of its ends with said one pair of opposite rails of said frame, and said adapter bar assembly having formed in one longitudinal edge thereof a pair of locating and locking slots for the spaced locator lugs on one side of the smaller size control panel and being of the same size and spacing as the first-named locatng and locking slots.

2. In a receiver as defined in claim 1, and said adapter bar assembly including an adapter bar body having said locating and locking slots in said one longitudinal edge thereof and further having notches in its opposite ends and in its longitudinal edge away from said locating and locking slots, said notches adapted to receive portions of said one pair of opposite rails of said frame, at least one of said rails having a locator recess for a part of the adapter bar body adjacent one of its notches, and cooperative guide and locator means on the opposite end of the adapter bar body and the opposite rail of said one pair and adjacent to the other notch of the adapter bar body.

3. In a receiver as defined in claim 2, and said cooperative guide and locator means comprising a rigid guide pin projecting outwardly of one face of said other notch and adapted to enter a guide and locator slot formed in the opposing face of said opposite rail.

4. In a receiver as defined in claim 3, and interengaging yielding detent means for the adapter bar assembly on one end of the assembly and on said opposite rail.

5. In a receiver as defined in claim 4, and said detent means comprising a yielding detent element on said adapter bar body within one of said notches, and an opposing detent recess means adapted to receive the yielding detent element in one face of the adjacent rail.

6. In a receiver as defined in claim 5, and the yielding detent element comprising a spring-loaded ball element projecting beyond one face of said notch, and said detent recess comprising a socket opening formed in the head of a screw secured within a screw-receiving opening of said adjacent rail.

7. In a receiver as defined in claim 6, and said ball element being contained within a threaded body which is adjustably received within a threaded bore formed in one face of said one of said notches.

8. In a receiver as defined in claim 2, and a locator tongue for the adapter bar body projecting from one face of said one notch and adapted for engagement within a locator recess formed in the opposing face of an adjacent one of said rails.

9. In a receiver as defined in claim 2, and said rails beng rectangular in cross section and said notches having right angular faces for engagement with corresponding faces of the rectangular rails when the adapter bar body is assembled therewith.

10. In a conversion kit for a receiver which interfaces with a control panel, said receiver having a frame including a pair of spaced opposing parallel rails of rectangular cross section, an adapter bar assembly to span the space between said rails in right angular relationship thereto and having a pair of spaced locating and locking slots in one longitudinal edge thereof to receive one pair of locator lugs on one side of a control panel, the adapter bar assembly having corner notches which are square in its opposite ends and in its longitudinal edge which is remote from said locating and locking slots, a rigid locking tongue projecting from one surface of one corner notch for reception in a cooperating locking recess in the opposing face of one rail, a guide projection extending from one surface of the other corner notch at right angles to the notch surface carrying said locking tongue, and a yielding detent means on the second surface of the last-named notch for interengagement with a detent recess in the opposing surface of the other rail.

* * * * *